US010912376B2

(12) United States Patent
Thompson

(10) Patent No.: US 10,912,376 B2
(45) Date of Patent: Feb. 9, 2021

(54) MULTI-STORAGE CARRYING CASE

(71) Applicant: Gerald Thompson, Jackson, MS (US)

(72) Inventor: Gerald Thompson, Jackson, MS (US)

( * ) Notice: Subject to any disclaimer, the term of this patent is extended or adjusted under 35 U.S.C. 154(b) by 0 days.

(21) Appl. No.: 16/446,712

(22) Filed: Jun. 20, 2019

(65) Prior Publication Data

US 2019/0387867 A1 Dec. 26, 2019

Related U.S. Application Data

(60) Provisional application No. 62/687,320, filed on Jun. 20, 2018.

(51) Int. Cl.
*A45F 3/46* (2006.01)

(52) U.S. Cl.
CPC ..... *A45F 3/46* (2013.01)

(58) Field of Classification Search
CPC ..... A45F 3/46; A45F 3/00; A45C 11/20
USPC ..... 206/541, 542, 576, 224, 235, 1.7, 371, 206/553, 581
See application file for complete search history.

(56) References Cited

U.S. PATENT DOCUMENTS 2,594,607 A * 4/1952 Anderson ..... A45D 33/26 220/6
3,612,335 A * 10/1971 Schurman ..... B65D 43/164 220/324
5,014,850 A 5/1991 Huff
5,257,721 A * 11/1993 Smith ..... B44D 3/04 206/1.7
5,515,974 A * 5/1996 Higson ..... A61F 17/00 206/570
6,153,857 A 11/2000 Gunnels
6,513,693 B1 2/2003 DeLoach
7,055,682 B1 * 6/2006 Domotor ..... A45C 11/24 206/214
2005/0218033 A1 * 10/2005 Curtis ..... A45D 27/22 206/581
2008/0142401 A1 6/2008 Trannon
2014/0284158 A1 9/2014 Reid

* cited by examiner

*Primary Examiner* — Rafael A Ortiz
(74) *Attorney, Agent, or Firm* — Argus Intellectual Enterprise; Daniel Enea; Jordan Sworen

(57) ABSTRACT

A multi-storage carrying case for storing utensils and accessories therein. The multi-storage carrying case provides a user with a device that includes a main compartment for storing large items, and a series of sub-compartments that store utensils and accessories that are commonly needed during and after eating food, including floss picks, napkins, drinking straws, and hand sanitizer, in a single, easily accessible location. The multi-storage carrying case includes an upper shell rotatably affixed to a lower shell, wherein the upper shell and the lower shell cooperatively form the enclosed main compartment in a closed configuration. The sub-compartments have a recessed area sub-flush from a lower base panel such that an open front face of each sub-compartment is positioned on a same plane as the lower base panel. Further, the lower base panel forms a divider between each of the sub-compartments to not commingle the items of the sub-compartments.

16 Claims, 4 Drawing Sheets

MULTI-STORAGE CARRYING CASE

CROSS REFERENCE TO RELATED APPLICATION

This application claims the benefit of U.S. provisional application No. 62/687,320 filed on Jun. 20, 2018; the above identified patent application is herein incorporated by reference in its entirety.

BACKGROUND OF THE INVENTION

The present invention relates to a multi-storage carrying case. More specifically, the present invention relates to a multi-storage carrying case that provides a user with a device that provides items that are commonly needed for use during and after eating food, including floss picks, napkins, drinking straws, and hand sanitizer, in a single, easily accessible location.

Individuals often have need for a variety of utensils and other items while eating or performing other routine tasks. Particularly, individuals who are traveling or work in their vehicles must often conduct various tasks while on the go or in their vehicle. These individuals eat in their vehicle or in a public place while on the run. It can be difficult to gather and organize utensils and other items that are used for before and after eating. Such utensils are individually sold and packaged requiring individuals to search multiple stores to find all of the necessary items. In order to utilize these items, users must purchase multiple packages, which contributes to environmental waste and occupy limited storage space, such as in a vehicle or office desk.

Another inconvenience is that existing devices fail to provide sub-compartments specifically configured to store utensils and accessories. For example, a lunch box or insulated container may provide one or more compartments or pockets, however these compartments or pockets fail to prevent the intermixing of objects positioned within each compartments or pockets during transport. Furthermore, these existing devices fail to maximize space within the case to provide space within a main compartment while providing access to the sub-compartments having the utensils and accessories stored therein.

In view of the above concerns, it is desirable to provide a container that includes multiple utensils and tools that are often used while eating, such that the utensils and tools are stored in one place such that they are readily accessible for use. Particularly, it is desirable to provide a container that includes individual compartments specifically sized and adapted to store floss picks, hand sanitizer, napkins, and straws.

In light of the devices disclosed in the known art, it is submitted that the present invention substantially diverges in design elements and methods from the known art and consequently it is clear that there is a need in the art for an improvement for multi-storage carrying cases. In this regard the instant invention substantially fulfills these needs.

SUMMARY OF THE INVENTION

In view of the foregoing disadvantages inherent in the known types of multi-storage carrying case now present in the known art, the present invention provides a new multi-storage carrying case wherein the same can be utilized for storing desirable utensils and accessories therein.

It is an objective of the present invention to provide a multi-storage carrying case having an upper shell rotatably affixed to a lower shell via a hinge, wherein the upper shell and the lower shell each comprises an upper shell sidewall and a lower shell sidewall extending around a perimeter of an upper base panel and a lower base panel, respectively. The upper shell and the lower shell cooperatively form an enclosed main compartment in a closed configuration when the shells are moved towards each other. The main compartment is formed by the upper shell sidewall and the lower shell, and the upper base panel and the lower base panel. The main compartment is adapted to store objects therein. The upper shell includes a straw sub-compartment dimensioned to receive one or more straws therein. The straw sub-compartment comprises a straw sidewall protruding from the upper base panel forming a channel having an open front face, such that the open front face of the straw sub-compartment is elevated from the upper base panel. A lateral width of the straw sub-compartment extends parallel a longitudinal axis of the hinge such that the one or more straws are oriented laterally therein. In one embodiment, a retention band extends perpendicularly across the open front face of the straw sub-compartment such that the retention band is configured to retain the one or more straws are oriented laterally within the straw sub-compartment. The lower shell comprises a napkin sub-compartment configured to store napkins therein, a sanitizer sub-compartment configured to store hand sanitizer therein, and a floss sub-compartment configured to store floss members therein. In one embodiment, each of the napkin sub-compartment, the sanitizer sub-compartment, and the floss sub-compartment comprise a recessed area sub-flush from the lower base panel having an open front face disposed on a same plane as the lower base panel.

It is therefore an object of the present invention to provide a new and improved multi-storage carrying case that has all of the advantages of the known art and none of the disadvantages.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
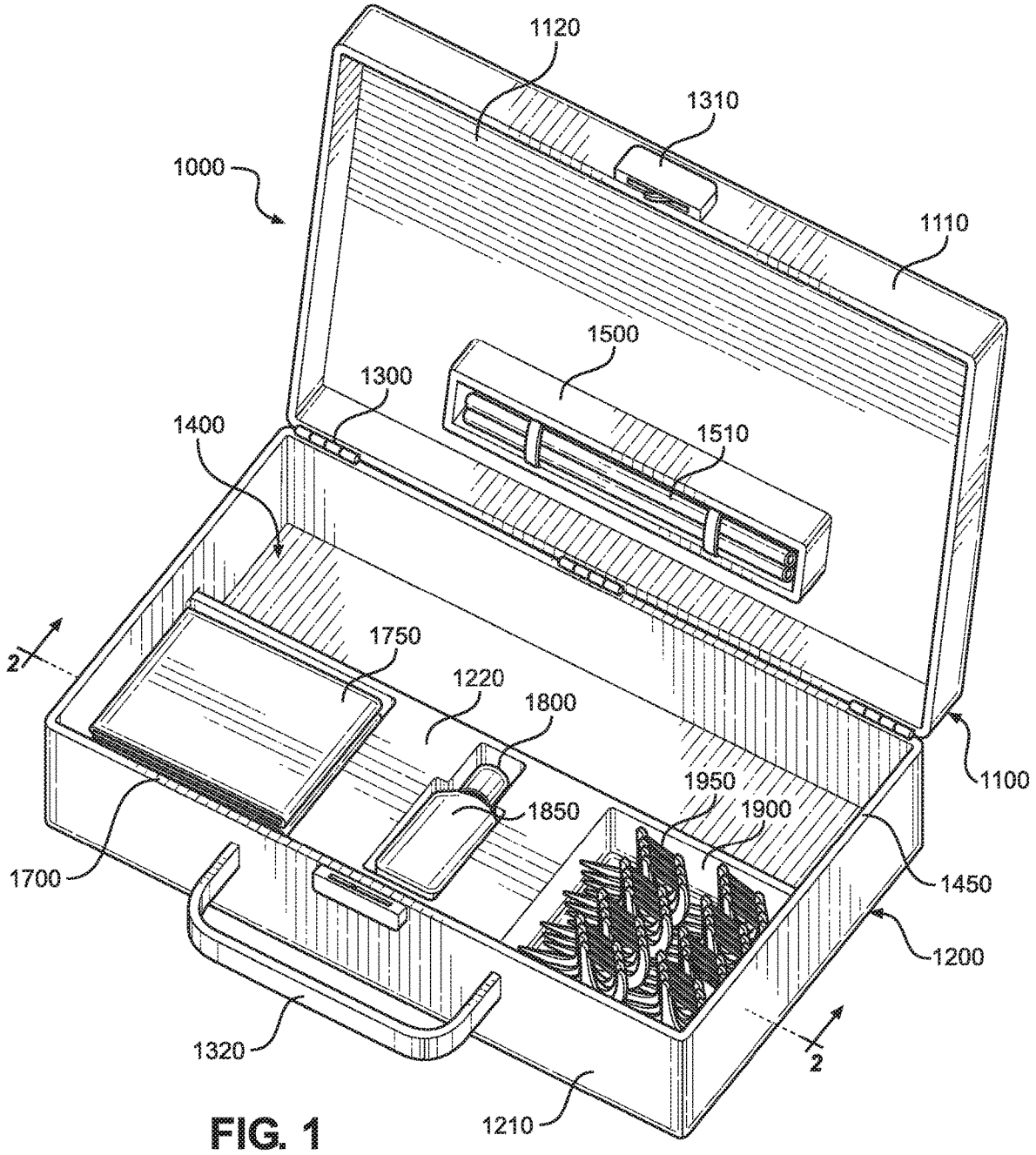
FIG. 1 shows a perspective view of an embodiment of the multi-storage carrying case.

Reference is made herein to the attached drawings. Like reference numerals are used throughout the drawings to depict like or similar elements of the multi-storage carrying case. For the purposes of presenting a brief and clear description of the present invention, the preferred embodiment will be discussed as used for storing utensils and accessories therein. The figures are intended for representative purposes only and should not be considered to be limiting in any respect.

Referring now to FIG. 1, there is shown a perspective view of an embodiment of the multi-storage carrying case. The multi-storage carrying case 1000 provides a user with a device that provides items that are commonly needed for use during and after eating food, including floss picks, napkins, drinking straws, and hand sanitizer, in a single, easily accessible location. The multi-storage carrying case 1000 comprises an upper shell 1100 affixed to a lower shell 1200 forming a container configured to store objects therein. In the shown embodiment, the upper shell 1100 and the lower shell 1200 are joined at one side via a hinge 1300 that provides for relative rotation of the shells 1100, 1200 for the purpose of the shells 1100, 1200 cooperatively providing access to an interior (and a main compartment 1400) and restricting access to the interior of the carrying case 1000 when closed. In the shown embodiment, the shells 1100, 1200 have an upper shell sidewall 1110 and a lower shell sidewall 1210 extending around a perimeter 1450 of an upper base panel 1120 and a lower base panel 1220, respectively. The rectangular perimeter 1450 includes equal dimensions so as to meet flushly and completely enclose the main compartment 1400. However, in alternative embodiments, the perimeter 1450 may comprise additional shapes, such as elliptical, circular, and the like. In one embodiment, the upper shell and the lower shell 1100, 1200 comprise a rigid material that retains a predetermined shape when in use. In an alternative embodiment, the upper shell and the lower shell 1100, 1200 comprise a fabric or flexible material that deforms with respect to the contents of objects stored therein.

In the illustrated embodiment, the lower shell sidewall 1210 comprises a larger vertical width than the upper shell sidewall 1110. The vertical width defined perpendicular to the base panels 1120, 1220. In this way, the lower shell comprises a larger interior area so as to maximize the storage space thereof. In alternate embodiments, the sidewalls comprise an equal width relative to one another.

In one embodiment, the hinge 1300 is a living hinge that is integral with both the upper shell and the lower shell 1100, 1200. In one embodiment, the carrying case 1000 further includes a latch or one or more mating fasteners 1310 disposed on the interior or an exterior of the carrying case 1000 configured to secure the upper shell and the lower shell 1100, 1200 in the closed configuration. In one embodiment, the one or more mating fasteners 1310 are disposed opposite the hinge 1300. Additionally, in some embodiments, the carrying case 1000 includes a handle 1320 disposed on the exterior of either or both the upper shell and the lower shell 1100, 1200. In the illustrated embodiment, the handle comprises a U-shape allowing for a user to easily grasp the carrying case 1000. However, in alternate embodiments, the carrying case is void of an exterior handle for compact/flush storage within a confined space, such as a desk drawer or vehicle console.

In the shown embodiment, the upper base panel 1120 and a lower base panel 1220 of the carrying case 1000 is generally extend between the boundaries of the upper shell sidewall 1100 and the lower shell sidewall 1210. Additionally, the upper shell 1100 comprises a straw sub-compartment 1500 dimensioned to receive one or more straws 1510 therein. In the shown embodiment, the straw sub-compartment 1500 extends laterally between opposing sides of the case 1000. The lower shell 1200 comprises a napkin sub-compartment 1700 configured to store napkins 1750 therein, a sanitizer sub-compartment 1800 configured to store hand sanitizer 1850 therein, and a floss sub-compartment 1900 configured to store floss members 1950 therein.

Figure 2:
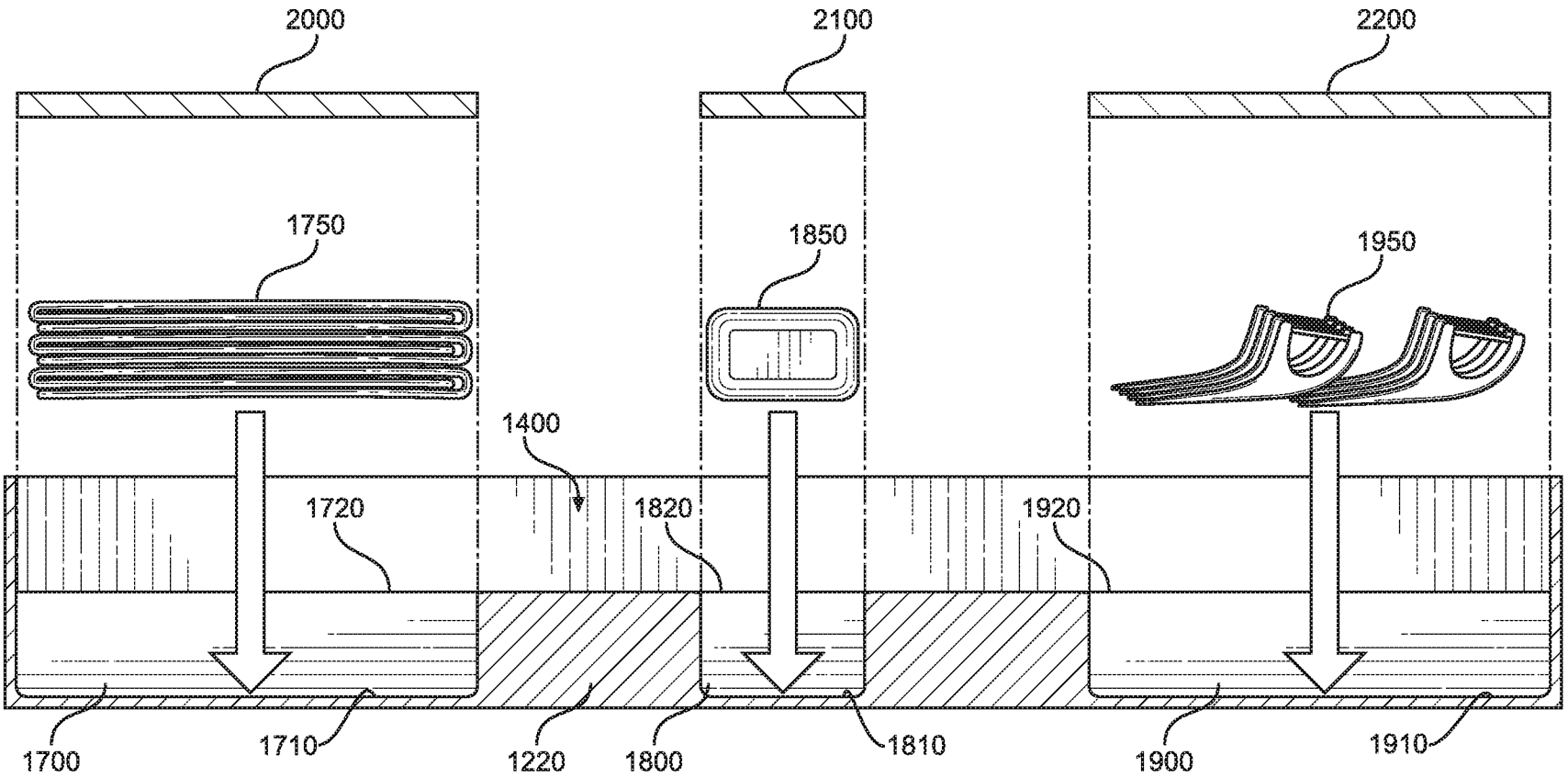
FIG. 2 shows a close-sectional view of an embodiment of the lower shell of the multi-storage carrying case taken along line 2-2 of FIG. 1.

Referring now to FIG. 2, there is shown a close-sectional view of an embodiment of the lower shell of the multi-storage carrying case taken along line 2-2 of FIG. 1. In the shown embodiment, each of the napkin sub-compartment 1700, the sanitizer sub-compartment 1800, and the floss sub-compartment 1900 comprise a recessed area sub-flush 1710, 1810, 1910 from the lower base panel 1220 having an open front face 1720, 1820, 1920 disposed on a same plane as the lower base panel 1220 of the carrying case 1000. In this way, the main compartment 1400 extends atop each the napkin sub-compartment 1700, the sanitizer sub-compartment 1800, and the floss sub-compartment 1900 to provide maximum space to the storage of objects therein while retaining the utensils and accessories within the respective sub-compartments.

In one embodiment, the napkin sub-compartment 1700 is configured to secure a pack of napkins therein, wherein the napkin 1750 compartment is sized to receive a thirteen inch by twelve inch pack of folded napkins, the sanitizer sub-compartment 1800 configured to receive a bottle of liquid material such as hand sanitizer 1950 therein, wherein the sanitizer sub-compartment 1800 is sized to receive a two ounce bottle of hand sanitizer, and the floss sub-compartment 1900 is configured to receive floss picks 1950 therein, wherein the floss sub-compartment 1900 is sized to receive a five inch by five and a half inch pack of floss picks 1950. In one embodiment, the floss picks 1950 are stored within a package container and subsequently stored within the floss sub-compartment 1900. In the shown embodiment, the lower base panel 1220 forms a divider between each of the sub-compartments 1700, 1800, 1900 so as keep the objects stored therein from commingling.

In one embodiment, a plurality of covers 2000, 2100, 2200 are dimensioned to fit across the open faces 1720, 1820, 1920 of the lower base panel 1220. The one or more sub-compartment covers 1700, 1800, 1900 removably covers each sub-compartment forming a continuous surface within the interior of the lower base panel 1220. In some embodiments, the sub-compartment cover is a single member sized to only cover each of the open front faces thereof. In other embodiments, the sub-compartment cover comprises a tab or finger aperture to allow a user to easily remove and insert the cover within the interior of the carrying case. In the shown embodiment, the sub-compartment covers 1700, 1800, 1900 are parallel to and comprises a same dimension as the lower base when disposed within the carrying case. In this way, the cover 1230 separates the sub-compartments from the main compartment. In some embodiments, the sub-compartment cover is pivotally secured along the hinge, between the upper shell and lower shell.

Figure 3:
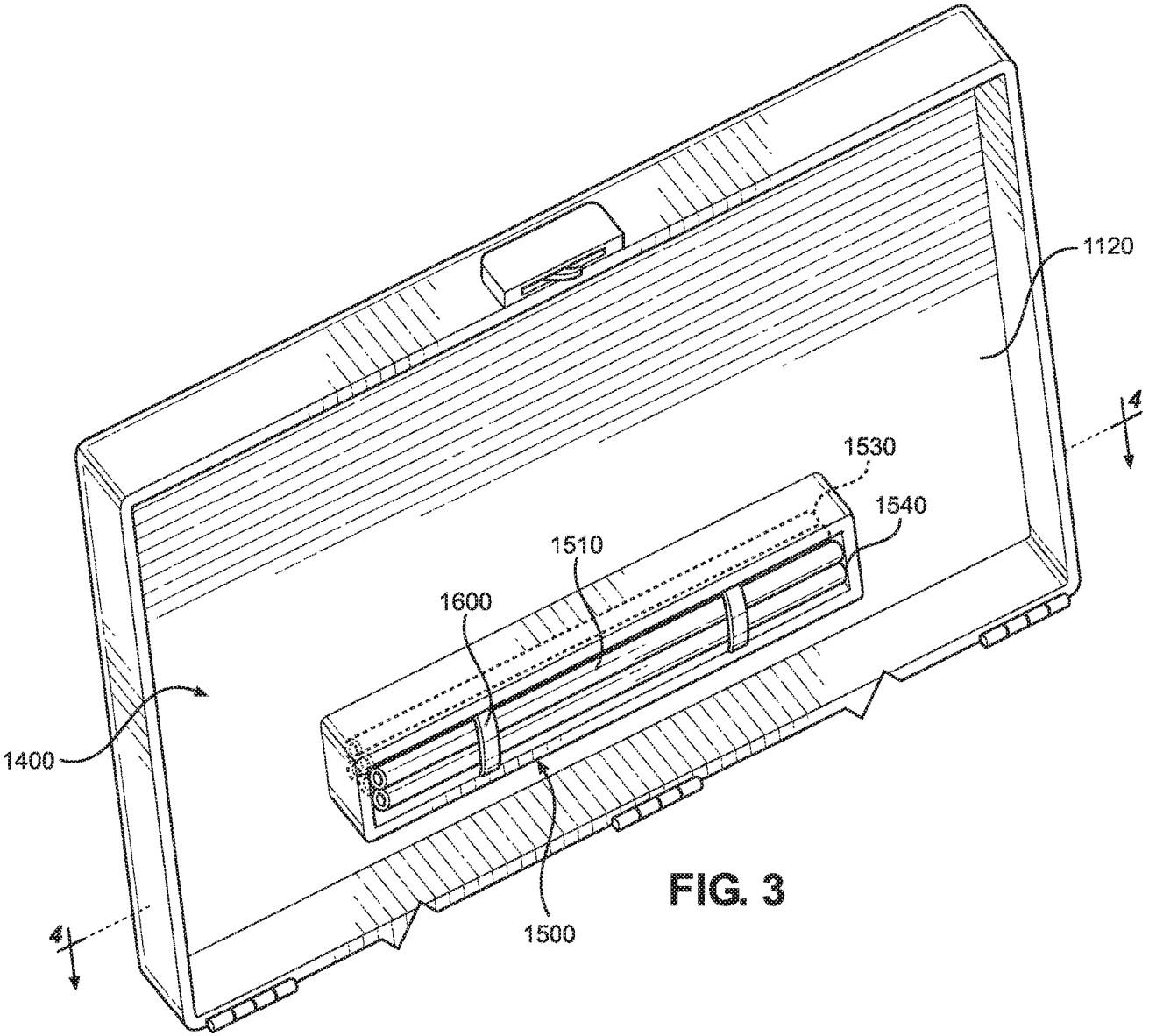
FIG. 3 shows a perspective view of an embodiment of the upper shell of the portable thermal insulated apparatus.
Figure 4:
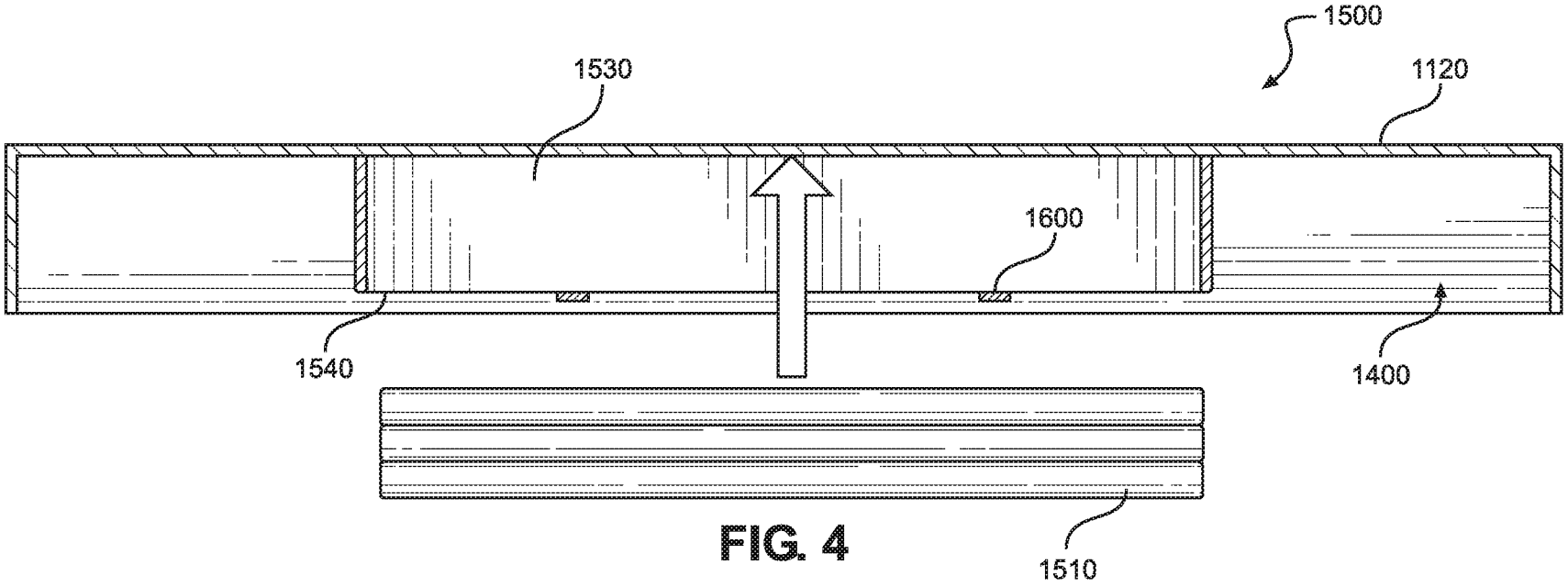
FIG. 4 shows a cross-sectional view of an embodiment of the upper shell of the multi-storage carrying case taken along line 4-4 of FIG. 3.

Referring now to FIGS. 3 and 4, there is shown a perspective view of an embodiment of the upper shell of the portable thermal insulated apparatus and a close-sectional view of an embodiment of the lower shell of the multi-storage carrying case taken along line 4-4 of FIG. 3, respectively. In the shown embodiment, the straw sub-compartment 1500 further comprises a straw sidewall 1520 protruding from the upper base panel 1120 forming a channel 1530 having an open front face 1540, such that the open front face 1540 of the straw sub-compartment 1500 is elevated from the upper base panel 1120. Further, in one embodiment the straw sub-compartment 1500 is disposed over a top half of the lower shell 1200, opposite the bottom half of the lower shell 1200 having the napkin sub-compartment 1700, the sanitizer sub-compartment 1800, and the floss sub-compartment 1900 in the closed configuration (see FIG. 1). In this way, the straw sub-compartment 1500 does not contact the contents of the any of the other sub-compartments 1700, 1800, 1900 (see FIG. 1). Further, the main compartment 1400 is provided with additional space for the storage of the contents.

In the shown embodiment, the straw sub-compartment 1500 has a lateral width extending parallel a longitudinal axis of the hinge (of which rotation of the shells 1100, 1200 rotate about), such that the one or more straws 1510 are oriented laterally therein. In this way, the one or more straws 1510 may be loaded and removed from the straw sub-compartment 1500 without interference from the contents of the main compartment 1400.

In the shown embodiment, a retention band 1600 extends perpendicularly across the open front face 1540 of the channel 1530, wherein the retention band 1600 is configured to retain the one or more straws 1510 that are oriented laterally within the straw sub-compartment 1500. In the shown embodiment, the retention band 1600 is an elastic band. Further, the straw sub-compartment 1500 may utilize one or more of the retention bands 1600 to secure the one or more straws 1510 therein.

In one embodiment, the napkin sub-compartment is sized to receive and retain napkins stored therein via a friction fit, the sanitizer sub-compartment is sized to receive and retain a bottle stored therein via a friction fit, and the floss sub-compartment is sized to receive and retain a bag of floss members stored therein via a friction fit.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A multi-storage carrying case, comprising:

an upper shell rotatably affixed to a lower shell via a hinge, wherein the upper shell comprises an upper shell sidewall extending around a perimeter of an upper base panel and the lower shell comprises a lower shell sidewall extending around a perimeter of a lower base panel;

wherein the upper shell and the lower shell cooperatively form an enclosed main compartment in a closed configuration, the main compartment adapted to store objects therein;

wherein the main compartment is defined by the upper shell sidewall and the lower shell, and the upper base panel and the lower base panel;

the upper shell comprising a straw sub-compartment dimensioned to receive one or more straws therein, the straw sub-compartment comprising:

a straw sidewall protruding from the upper base panel forming a channel having an open front face, such that the open front face of the straw sub-compartment is elevated from the upper base panel;

wherein the upper base panel is disposed on a horizontal plane offset from the open front face, such that the straw sub-compartment is disposed facing the main compartment in the closed configuration;

a lateral width extending parallel a longitudinal axis of the hinge such that the one or more straws are oriented laterally therein;

a retention band extending perpendicularly across the open front face configured to retain the one or more straws are oriented laterally within the straw sub-compartment;

the lower shell comprises a napkin sub-compartment configured to store napkins therein, a sanitizer sub-compartment configured to store hand sanitizer therein, and a floss sub-compartment configured to store floss members therein;

wherein each of the napkin sub-compartment, the sanitizer sub-compartment, and the floss sub-compartment comprise a recessed area sub-flush from the lower base panel having an open front face disposed on a same plane as the lower base panel wherein the napkin sub-compartment, the sanitizer sub-compartment, and the floss sub-compartment are disposed on a bottom half of the lower shell, wherein the lower shell is divided into a top half and a bottom half by an axis that extend parallel the hinge and between lateral sides thereof.

2. The multi-storage carrying case of claim 1, wherein the upper shell and the lower shell are rigid.

3. The multi-storage carrying case of claim 1, wherein the hinge is a living hinge.

4. The multi-storage carrying case of claim 1, wherein each sub-compartment is adapted to retain the respective members via friction fit.

5. The multi-storage carrying case of claim 1, wherein the upper shell and the lower shell comprise mating fasteners for securing the multi-storage carrying case in the closed configuration.

6. The multi-storage carrying case of claim 1, wherein the lower shell comprise a handle.

7. The multi-storage carrying case of claim 1, further comprising the napkin disposed within the napkin sub-compartment.

8. The multi-storage carrying case of claim 1, further comprising the sanitizer disposed within the sanitizer sub-compartment.

9. The multi-storage carrying case of claim 1, further comprising the floss member disposed within the floss sub-compartment.

10. The multi-storage carrying case of claim 1, wherein a seal between the upper shell and the lower shell is waterproof.

11. The multi-storage carrying case of claim 1, wherein the napkin sub-compartment, the sanitizer sub-compartment, and the floss sub-compartment comprise a cover that extends only over the recessed area configured to rest flush with the lower base panel, such that a perimeter of the cover is similarly sized to each respective recessed area of the napkin sub-compartment, the sanitizer sub-compartment, and the floss sub-compartment.

12. The multi-storage carrying case of claim 1, wherein the napkin sub-compartment and the floss sub-compartment are disposed on opposing sides of the lower shell to provide balanced distribution of weight of the lower shell.

13. The multi-storage carrying case of claim 1, wherein the sanitizer sub-compartment is disposed between the napkin sub-compartment and the floss sub-compartment, such that the sanitizer sub-compartment is equidistant to both the napkin sub-compartment and the floss sub-compartment.

14. The multi-storage carrying case of claim 1, wherein the napkin sub-compartment and floss sub-compartment are disposed toward a lateral side edge of the interior volume of the housing, wherein the sanitizer sub-compartment is disposed therebetween.

15. The multi-storage carrying case of claim 11, wherein each cover, when seated within the respective napkin sub-compartment, sanitizer sub-compartment, and floss sub-compartment, forms a flat continuous surface with the lower base panel.

16. A multi-storage carrying case, comprising:

an upper shell rotatably affixed to a lower shell via a hinge, wherein the upper shell comprises an upper shell sidewall extending around a perimeter of an upper base panel and the lower shell comprises a lower shell sidewall extending around a perimeter of a lower base panel;

wherein the upper shell and the lower shell cooperatively form an enclosed main compartment in a closed configuration, the main compartment adapted to store objects therein;

wherein the main compartment is defined by the upper shell sidewall and the lower shell, and the upper base panel and the lower base panel;

the upper shell consisting of a straw sub-compartment dimensioned to receive one or more straws therein, the straw sub-compartment consisting of:

a straw sidewall protruding from the upper base panel forming a channel having an open front face, such that the open front face of the straw sub-compartment is elevated from the upper base panel;

a lateral width extending parallel a longitudinal axis of the hinge such that the one or more straws are oriented laterally therein;

a retention band extending perpendicularly across the open front face configured to retain the one or more straws are oriented laterally within the straw sub-compartment;

the lower shell consisting of a napkin sub-compartment configured to store napkins therein, a sanitizer sub-compartment configured to store hand sanitizer therein, and a floss sub-compartment configured to store floss members therein;

wherein each of the napkin sub-compartment, the sanitizer sub-compartment, and the floss sub-compartment comprise a recessed area sub-flush from the lower base panel having an open front face disposed on a same plane as the lower base panel.

* * * * *